US007243815B2

(12) United States Patent
Coppedge et al.

(10) Patent No.: US 7,243,815 B2
(45) Date of Patent: Jul. 17, 2007

(54) THERMOFORMED PACKAGE

(75) Inventors: Johnny Coppedge, West Linn, OR (US); Salvatore Cesario, West Linn, OR (US); Nicholas Malone, Rockford, MI (US)

(73) Assignee: See The Shoes, LLC, West Linn, OR (US)

( * ) Notice: Subject to any disclaimer, the term of this patent is extended or adjusted under 35 U.S.C. 154(b) by 0 days.

(21) Appl. No.: 10/368,043

(22) Filed: Feb. 14, 2003

(65) Prior Publication Data

US 2004/0056030 A1 Mar. 25, 2004

Related U.S. Application Data

(63) Continuation-in-part of application No. PCT/US02/30075, filed on Sep. 23, 2002.

(51) Int. Cl.
*B65D 25/28* (2006.01)

(52) U.S. Cl. ..... 220/769

(58) Field of Classification Search ..... 220/4.23, 220/839, 4.22, 4.27; 206/508
See application file for complete search history.

(56) References Cited

U.S. PATENT DOCUMENTS

| | | | | | |
|---|---|---|---|---|---|
| 2,217,455 | A | * | 10/1940 | Price et al. | 206/320 |
| 2,956,677 | A | | 10/1960 | Kavaldlo | |
| 3,369,660 | A | | 2/1968 | Hartman | |
| 3,407,961 | A | | 10/1968 | Box | |
| 3,414,093 | A | | 12/1968 | Chostner | |
| 3,504,787 | A | * | 4/1970 | Brockway | 206/570 |
| 3,937,389 | A | * | 2/1976 | Wind | 229/406 |
| 4,234,080 | A | * | 11/1980 | Gellert | 206/0.82 |
| 4,244,508 | A | | 1/1981 | Schulman | |
| D260,080 | S | * | 8/1981 | Ravotto et al. | D9/418 |
| 4,375,262 | A | * | 3/1983 | Hrenyo | 206/418 |
| 4,795,029 | A | | 1/1989 | Campbell et al. | |
| 4,819,795 | A | | 4/1989 | Swaney | |
| 5,038,937 | A | * | 8/1991 | DiSesa, Jr. | 206/501 |
| 5,139,165 | A | * | 8/1992 | Hara | 220/339 |
| 5,176,272 | A | * | 1/1993 | Ryan | 220/4.23 |
| 5,251,106 | A | * | 10/1993 | Hui | 361/744 |
| 5,271,515 | A | * | 12/1993 | Berkheimer et al. | 220/4.27 |
| D344,890 | S | | 3/1994 | Townes | |
| 5,293,993 | A | | 3/1994 | Yates, Jr. et al. | |
| 5,577,613 | A | * | 11/1996 | Laidlaw | 206/510 |
| 5,954,203 | A | | 9/1999 | Marconi | |
| 6,138,850 | A | * | 10/2000 | Berry, III | 220/4.28 |
| 6,213,298 | B1 | | 4/2001 | Nguyen | |
| 6,237,792 | B1 | * | 5/2001 | Skolnicki et al. | 215/382 |
| 6,305,533 | B1 | | 10/2001 | Welty et al. | |
| 6,321,911 | B1 | | 11/2001 | Raimer et al. | |
| 6,378,719 | B1 | * | 4/2002 | Kaiser | 220/475 |
| 6,454,115 | B1 | * | 9/2002 | Allasia | 220/4.23 |

* cited by examiner

*Primary Examiner*—Stephen J. Castellano
(74) *Attorney, Agent, or Firm*—ipsolon llp

(57) ABSTRACT

A container is formed in a blank having two body halves interconnected by a hinge. The container body is at least partially clear to allow inspection of an article held in the interior. The container optionally includes an integrally formed carrying handle. Empty containers are nested to minimize shipping space. Each container optionally includes stack-stabilizing structure so that plural containers may be stacked into stable stacks, and any selected container may be easily removed from the stack. The inventive container protects articles held therein during shipping and storage, and displays the articles both before and after sale.

14 Claims, 5 Drawing Sheets

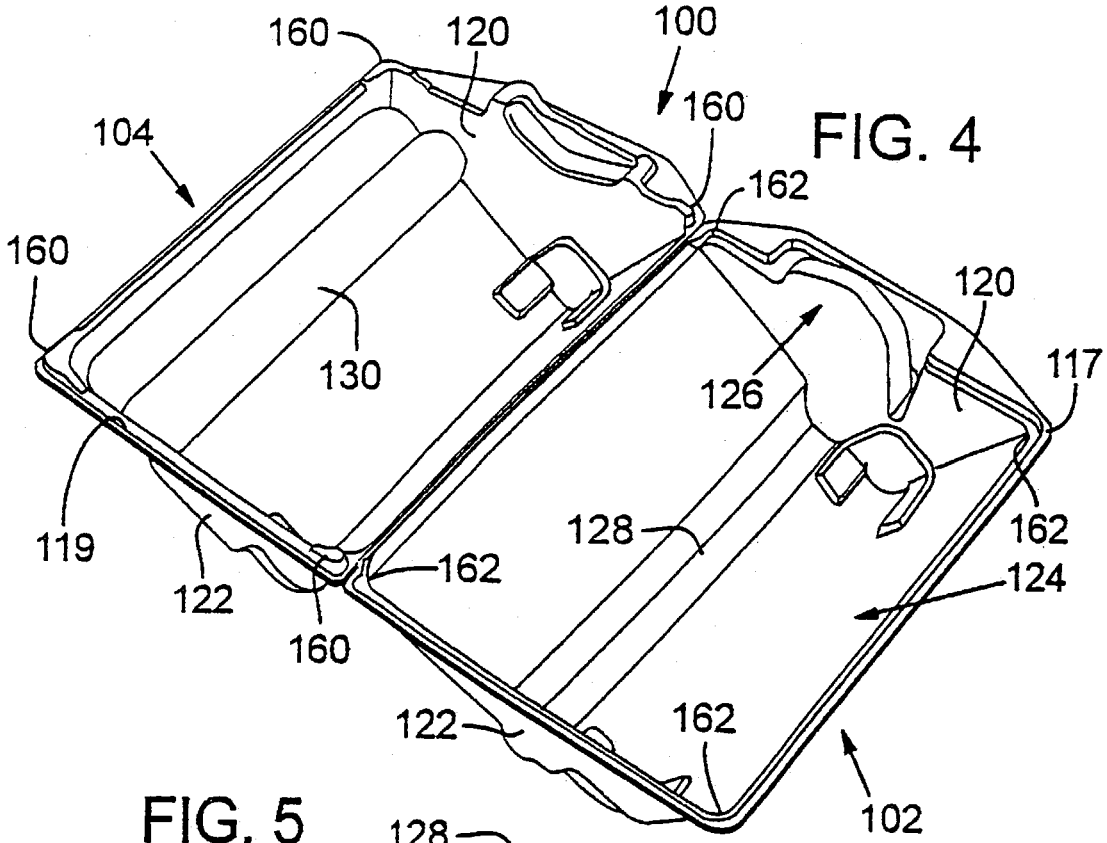
FIG. 4
FIG. 5
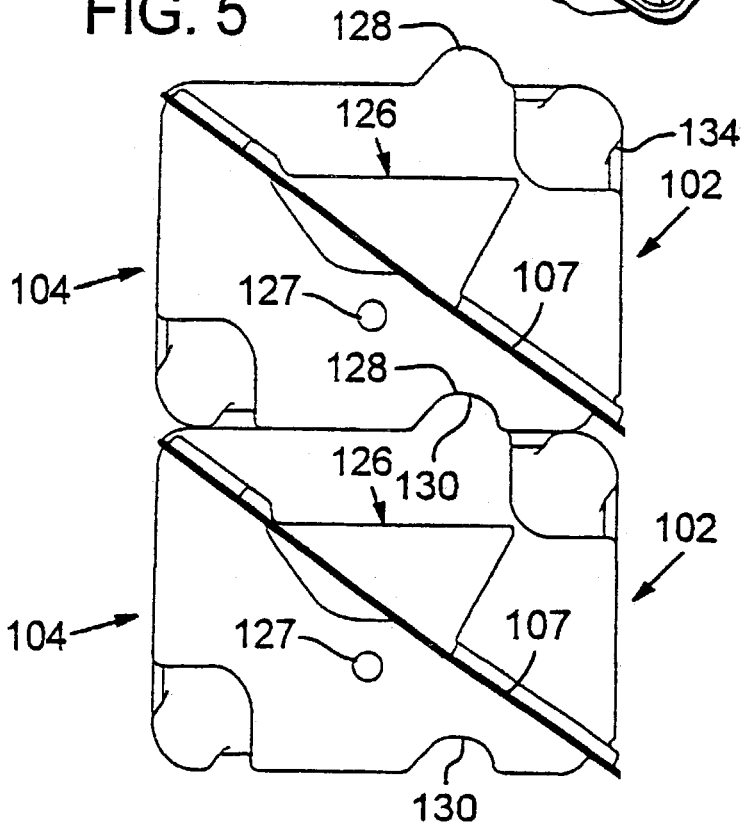

THERMOFORMED PACKAGE

RELATED APPLICATION DATA

This is a Continuation in Part of PCT/US02/30075, filed Sep. 23, 2002.

FIELD OF THE INVENTION

This invention relates to the field of packaging, and more particularly, to a thermoformed package designed for use with any variety of goods, but especially for footwear.

BACKGROUND

Thermoformed containers are used ubiquitously as packaging for innumerable objects. Generally speaking, containers formed by thermoforming processes offer economical packaging options for a variety of consumer goods, and at many different distribution levels. For example, thermoformed containers may be used as competitive replacements for paperboard and cardboard-based packages for many items. The following description of the packaging industry as it relates to footwear is just one example of the demands for packaging.

The market for consumer footwear is notoriously competitive and there are numerous footwear manufacturers competing for a share of that market. The intense level of competition in the footwear industry is found in nearly every market sector, and regardless of the particular type of shoe. However, the competition is perhaps most keenly focused in the market sector pertaining to active shoes and athletic shoes. In this market sector as well as others, competitors are constantly searching for ways to increase sales and market shares. Some of the most successful, and thus commonly used marketing techniques, are very familiar to most consumers. Examples include rapid introduction of new styles, product endorsements by famous athletes, intense brand name marketing and promotion, and advertising directed to specific consumer groups such as consumers falling into specific targeted demographic groups. These techniques along with other marketing activities help give footwear manufacturers a competitive edge in a highly competitive market.

Traditional shoeboxes are sometimes utilized for marketing purposes in addition to their more traditional function. Shoes of all types are usually packaged in traditional rectangular shoeboxes manufactured from some kind of paperboard, often cardboard. However, while such boxes serve an accepted functional role of storing and protecting the shoes, they do little to promote the product itself, other than minimal promotional information printed on the boxes.

While there are many different styles of shoeboxes, nearly all of them are variations on a standard theme: a rectangular box that is usually made of cardboard. Such boxes are useful for many reasons. From a purely functional point of view, rectangular shoeboxes provide a reasonably secure internal compartment for storing the shoes after manufacturing, and all the way from the factory to the consumer sales outlet. And traditional boxes are easily stacked, whether for shipping in containers from an offshore manufacturing location to a warehouse, for storage in a warehouse or a retail outlet, or for storing product for consumer inspection at warehouse-type retail outlets. While the internal compartment of a rectangular box is not custom designed to hold a pair of shoes, most shoes are held reasonably well in a standard box when the shoes are nested in the traditional opposed orientation, and generally with a paper sleeve inserted between the shoes to prevent them from rubbing together and scuffing.

But in addition to their functional benefits, traditional rectangular shoeboxes serve another purpose, and that is as a part of the marketing plan. Nearly all shoe manufacturers try to use their product packaging as part of their overall marketing programs designed to sell the product. Thus, many shoe manufacturers print graphics and other promotional information on their boxes. Even though this marketing information may be visible only on the sides of the boxes since boxes are usually stacked, the space can be used as advertising space. Moreover, the box may be printed with information about the shoes—sizes and the like.

However, there are several problems evident in traditional shoeboxes. First, the standard rectangular box design necessarily takes up more space than is needed to contain the shoes. Even when nested in an opposed orientation, a pair of shoes defines a shape that is seldom a regular rectangle, and as a result, most standard shoeboxes have excess materials and take up more space than is necessary. These factors increase costs of the product. For example, minimizing the amount of raw material used to make the box could reduce material costs tied up in the packaging. Likewise, eliminating excess packaging material that takes up added space can reduce shipping and storage costs.

Second, most shoeboxes are made of some form of paper—usually cardboard or a heavy paperboard. While such materials tend to make a relatively strong container, the can be crushed and are subject to moisture absorption and damage. Moisture damage to cardboard can be a significant problem. And even broken-down cardboard boxes designed for shoes tend to take up a significant amount of space. Further, the boxes must be manufactured in one location as blanks, shipped to another location where they are set up as boxes. Finally, raw material costs for cardboard are increasing at a steady rate, making the economics of using cardboard less and less favorable.

But perhaps the greatest shortcoming of traditional, rectangular shoeboxes is their limited ability to enhance product sales. As noted above, most shoe manufacturers print promotional information of one kind or another on their shoeboxes, including trademarks, logos and the like. This is valuable to a degree in selling the product. But cardboard is inherently opaque, and as such, a consumer must open the box to look at the shoes contained inside. Shoe manufacturers want their consumers to look at their shoes—the appearance of the shoe is an important factor in the consumer's decision on what to buy. It can be difficult to pull a box out of a stack of boxes, open it to look at the shoe, and then replace the shoe in the box in even a relatively neat fashion. Stated in another way, a large part of the consumer's buying decision is based upon the appearance of the shoe. As a result, shoe manufacturers spend a great deal of time and money in making their shoes look attractive to consumers—the manufacturers want consumers to see the product. But for all of this, shoes are almost always hidden in a shoebox.

As noted, the foregoing is but one example of some shortcomings of traditional, paper-based packaging. There is a real need for improved packaging containers.

The present invention provides a see-through display container that overcomes the problems in the prior art, and at the same time provides substantial marketing and product promotion advantages for whatever product might be held in the container. To name a few examples of the advantages that the inventive package provides, the container actually helps promote the product held within the container and increase sales by presenting the product in a container that the consumer can see through. The product includes an integral handle so that the container itself functions as a carrying case for the enclosed product. This allows retailers to stop putting traditional boxes in bags, which of course are an unnecessary and thus wasteful expense. In addition, since the container is see-through, other consumers will be able to see what the purchaser has purchased. This is a further promotional tool.

The invention illustrated and described herein is a container that may be used as a package for many different objects. The structural features of the invention and the manner in which the inventive package is formed make the container useful in numerous industries for innumerable goods. Nonetheless, the package of the present invention is described below with particular reference to its use as a container for footwear. While the description of the invention sometimes focuses on a footwear container, it is to be understood that the principles of the invention apply to the container used for other purposes, and that the invention is not limited to use as a footwear container, but is instead limited only by the appended claims.

In a preferred embodiment the present invention comprises a shoe container formed of a clear or translucent plastic that is formed such that a pair of shoes fits precisely into the interior of the container and is visible through the container. The container may be formed in any size to accommodate any sized shoe. The container of the present invention may be formed to define an interior space that conforms to the size and dimensions of a particular style of shoe, or other items. Thus, little space is wasted on both the interior and exterior and manufacturing, shipping and storage costs are minimized.

The containers are preferably thermoformed in a one-piece clamshell configuration that includes an integral hinge and carrying handle. The package is formed in a manner that results in a strong container that protects items contained therein. Moreover, the package embodies structural features that provide unique storage and stacking capabilities.

In one embodiment the containers are manufactured from transparent polymeric materials that resist cracking and breaking, and which withstand impact. The containers may be nested so that storage space is minimized. When the containers are packaged with shoes, the halves of the clamshell package are closed over the shoes and are securely latched or interconnected to provide a secure package. With particular reference to footwear, the shoes may be oriented within the container in such a manner to ideally display the shoes to consumers. In a preferred embodiment, the shoes are oriented in the traditional toe-to-heel orientation.

The outer dimensions of the containers are configured to optionally include stack stabilization features so that multiple containers may be stacked in stable layers. In one preferred embodiment, the containers include outwardly facing protrusions or rails that nest into a complimentary and cooperative structure in the next adjacent container when stacked. This allows a single container to be easily removed from a large stack of containers.

The container may be formed of many different types of plastics, including plastics containing significant levels of recycled materials. Many kinds of plastics used to make the inventive container may be recycled after use. The plastic may be colored to match the color scheme that the manufacturer has selected for the shoe, and the color of the container may thus be combined into a marketing plan. Written indicia such as brand names and logos may be printed on or formed in the container.

BRIEF DESCRIPTION OF THE DRAWINGS

The invention will be better understood and its numerous objects and advantages will be apparent by reference to the following detailed description of the invention when taken in conjunction with the following drawings.

FIG. 4 is perspective, top view of the container shown in FIG. 1 with the container in a fully open position to expose the interior space of the container.

FIG. 5 is a right side elevational view of a stack of two closed containers of the type illustrated in FIG. 1.

DETAILED DESCRIPTION OF THE PREFERRED EMBODIMENTS

Preferred embodiments of the container of the present invention are shown in the FIGS. 1 through 9. The invention is described at times herein with respect to an exemplary design intended for use with footwear such as athletic shoes. However, the invention as defined in the appended claims is not limited to a container for shoes, and those of ordinary skill in the art will instead recognize that the invention applies to containers for any kind of goods.

Figure 1:
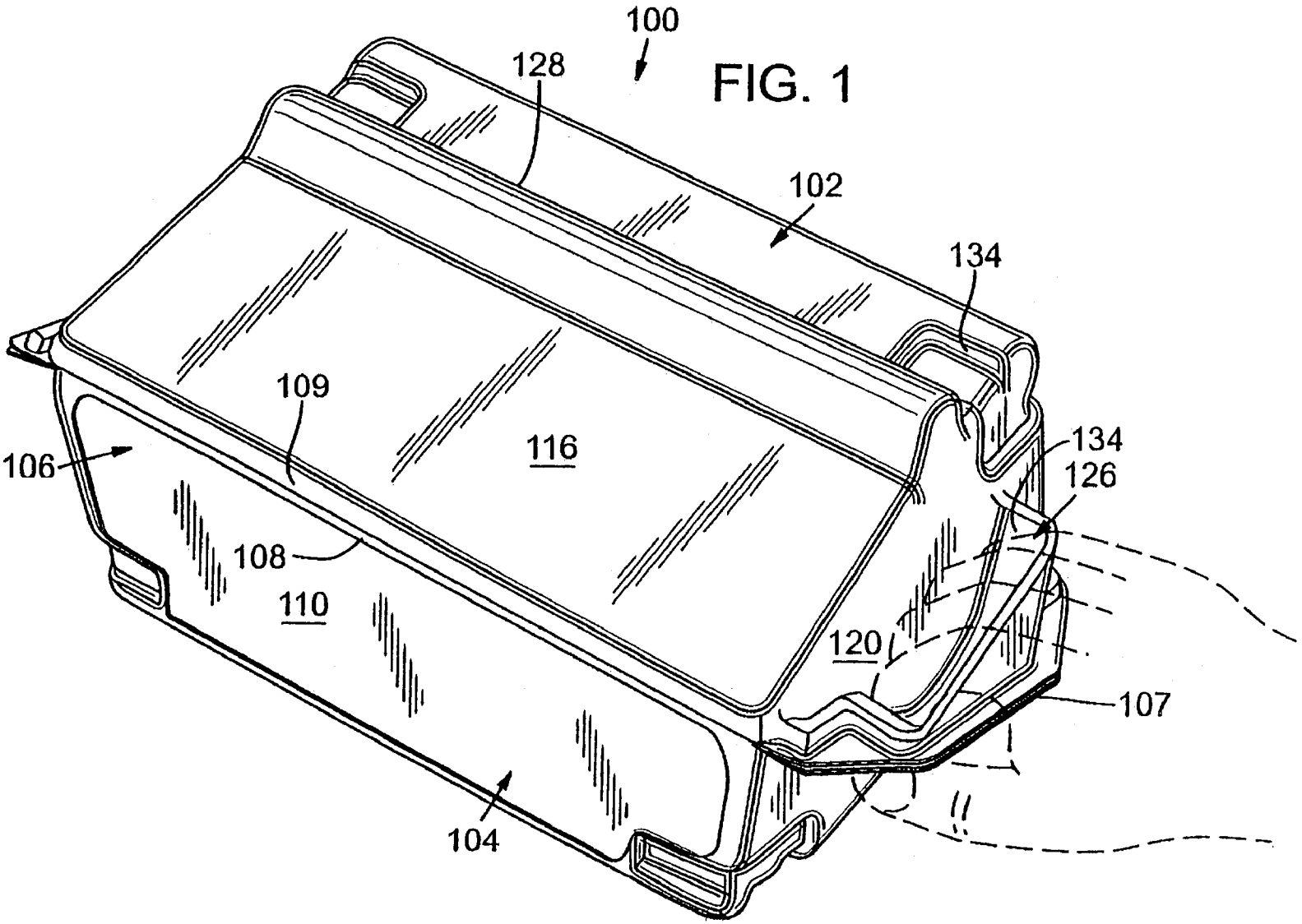
FIG. 1 is a perspective view of one preferred embodiment of a container according to the present invention.

With reference to FIG. 1, container 100 is formed in two body halves, namely a first body half 102 and a second body half 104, which are joined together and integrally interconnected at a hinge 106. The hinge 106 is fabricated from the same material as the body halves, as opposed to being fabricated from a different material or in a different piece, and the hinge is not cut during formation of the container. The container 100 is preferably formed in a single piece by thermoforming, as described below. Body halves 102 and 104 are sized to mate with one another when closed about hinge 106 so that the two halves lock together such that they define an open interior space configured for receiving an article, such as a pair of shoes.

Figure 2:
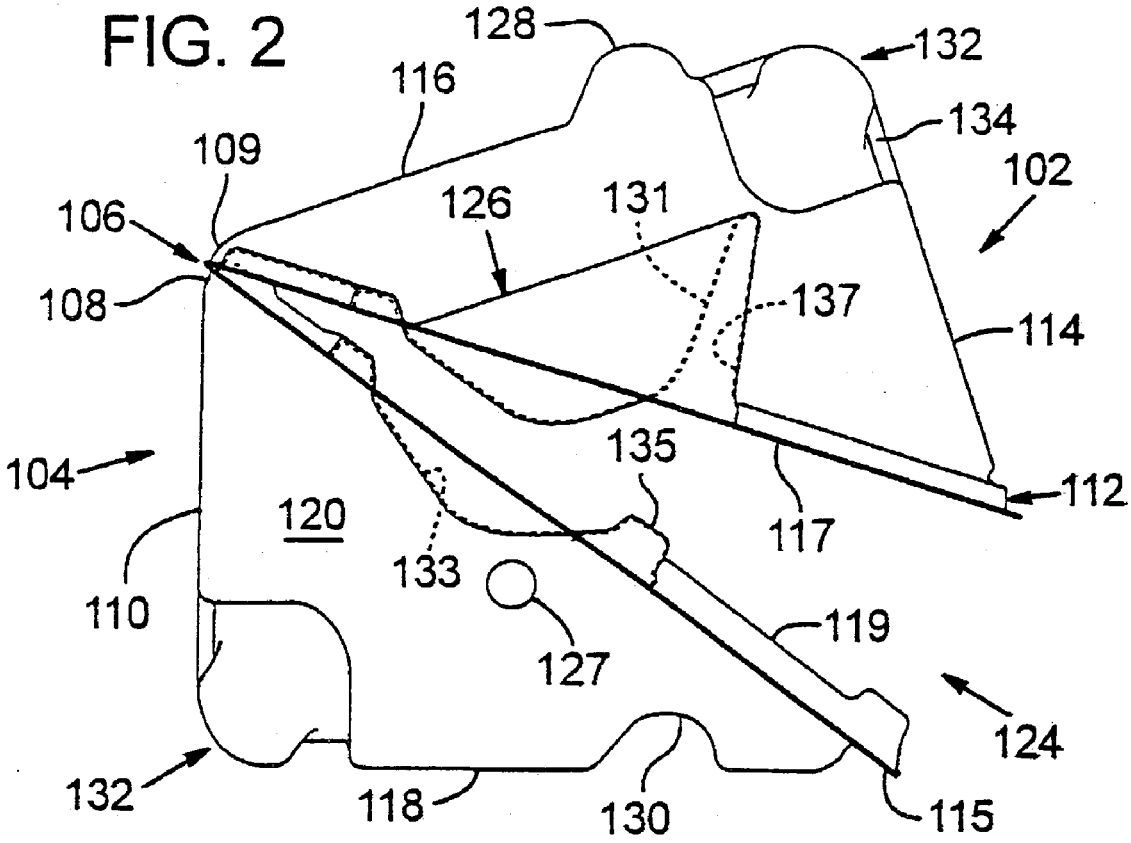
FIG. 2 is right a side elevational view of the container illustrated in FIG. 1, and showing the container partly opened.
Figure 3:
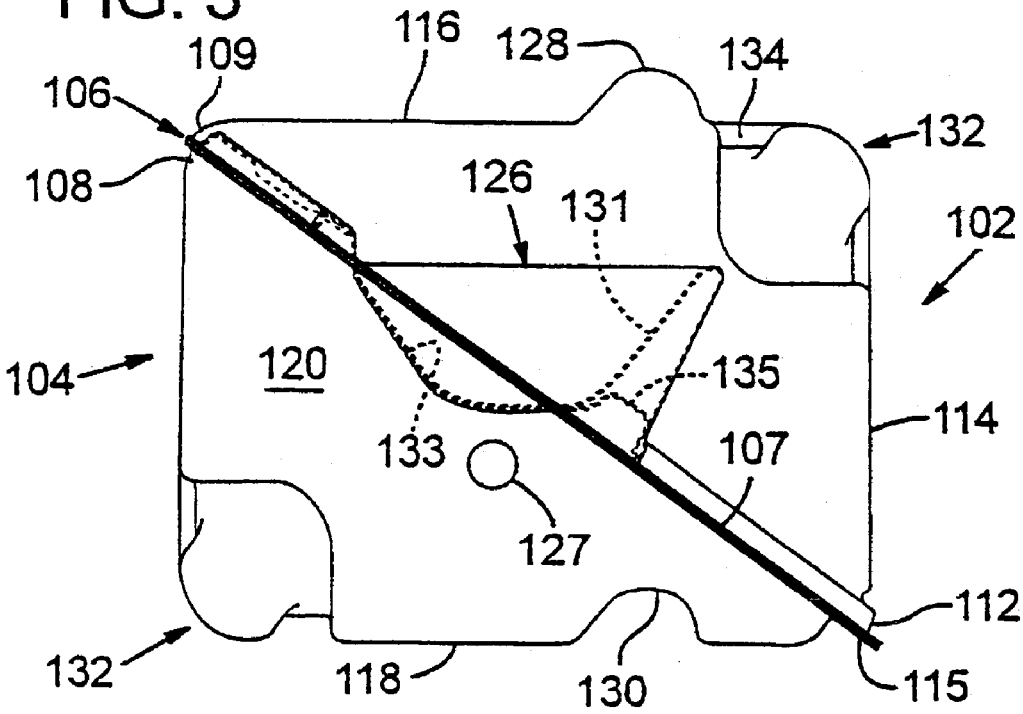
FIG. 3 is a right side elevational view of the container illustrated in FIG. 2, in which the container is closed.

As shown particularly well in FIGS. 2 and 3, a joint 107 extends between the two body halves 102 and 104 when the body halves are mated together (i.e., when container 100 is closed). Joint 107 extends diagonally across the lateral end panels of the container. More specifically, hinge 106 connects the body halves 102 and 104 between an upper edge 108 of rear panel 110 of body half 104, and the adjacent rear edge 109 of top panel 116 of body half 102. The joint 107 between the two body halves extends in a diagonal direction extending from the hinge 106, across the lateral side panels (one of which is illustrated in FIGS. 2 and 3 and is given reference number 120) and to the lower edge 112 of front panel 114 of body half 102. The corresponding lower edge of body half 104 is given reference number 115.

The diagonal joint 107 does not obstruct any of the four main panels of container 100, thereby providing for an unobstructed view of items such as shoes held in the container through the four largest sides of the container. Thus, the top panel 116 and front panel 114 of body half 102, and the bottom panel 118 and rear panel 110 of body half 104 are unobstructed by a hinge or joint of any kind. Only the lateral side panels 120 and 122, respectively, are bisected by the joint 107.

The two-body halves 102 and 104 respectively define a base unit and a lid that covers the base unit and which closes the halves together. In the embodiments illustrated in the figures, the base (e.g. body half 104) and the lid (e.g. body half 102) are divided diagonally at joint 107, so that each of the base and the lid contribute approximately the same amount of interior space.

The body halves 102 and 104 include cooperatively formed peripheral edges that assist in locating the body halves with respect to one another when closed together, and to retain the halves in the closed position. Thus, a flange 117 extends around the periphery of body half 102 and defines a recessed flange that cooperatively mates with a flange 115 that extends around the periphery of body half 104. The two flanges 117 and 115 are cooperatively formed so that a friction-fit is defined between the two body halves when they are closed together, as shown in FIGS. 2 and 3.

Cooperatively formed tabs and tab-receiving recesses may be formed along the mating edges of flanges 117 and 115 to assist in maintaining the two body halves in the closed position shown in FIG. 1. Thus, when the two body halves 102 and 104 are closed—that is, moving the halves from the position shown in FIG. 2 into the position shown in FIG. 3—flange 115 mates with and is received into flange 117, and the flanges thus align to define the joint 107 (FIG. 1). There is a friction fit between flanges 117 and 115, which contributes to holding the two halves in the closed position of FIG. 1. Referring now to FIG. 4, the friction fit between the two halves is aided by tabs 160 formed around the periphery of flange 115 in body half 104. When the body halves are closed, the tabs 160 are received into cooperatively formed recesses 162 spaced around the periphery of flange 117 of body half 102 and located such that each tab 160 is received into a recess 162 when the body halves are closed together.

A carrying handle 126 is integrally formed in one of the lateral side panels, and in the illustration the handle 126 is formed in side panel 120. FIG. 1 illustrates how the handle may be grasped to pull the container. An optional opening 127 is formed in panel 120 below the lower extent of handle 126. If used, opening 127 provides an alternate way to grasp container 100, and in particular allows the container to be picked from a stack with a long rod having a hook on the end. Many stores and warehouses and the like place inventory on racks that may be quite high. A specific container that may otherwise be out of reach may be obtained by inserting a hook rod into opening 127 and pulling the container out of the stack. Opening 127 also functions as a vent to allow air to enter and escape from the container 100. Additional vent holes may be formed in container 100 during the manufacturing process as vents, if desired.

With reference now to FIGS. 1 through 3, the specific construction of handle 126 may be detailed. Thus, handle 126 is defined by a integral pocket 131 formed into and projecting outwardly from side panel 120 of body half 102. Flanges 117 and 115, and thus joint 107 extend around the outer periphery of pocket 131. At its lowermost point, pocket 131 extends below joint 107. A cooperative pocket 133 is formed in side panel 120 of body half 104 in a position to receive the lower portions of pocket 131 when the two body halves are in the closed position as seen in FIG. 3. A protrusion 135 formed on flange 115 is received in an opening 137 that is formed in flange 117 during formation of the container. The combination of protrusion 135 as it fits into opening 137 helps stabilize the handle, as does the combination of pocket 131 as it fits into cooperative pocket 133 when the container is closed. As used herein, relative directional terms such as "inwardly" or "outwardly" are used to refer to directions relative to the inside and outside of the container when it the two body halves are closed. Likewise, "upwardly" and "downwardly" are used in reference to the ground plane, which for purposes herein is the plane that is parallel to bottom panel 118 (FIG. 2). It will be appreciated that protrusion 135 may be used as an alternate way to grasp container 100, and thus allows the container to be picked from a stack with a long rod having a tip on the end that is capable of fitting into the protrusion from the lower side of the container. As noted above, many stores and warehouses place inventory on racks that may be quite high. A specific container that may otherwise be out of reach may be obtained by inserting a rod tip into protrusion 135 and pulling the container out of the stack.

Container 100 also includes optional stack stabilization structures that allow numerous containers to be stacked atop one another in a stable stack, yet so that a selected container may easily be pulled out of the stack without unstacking or upsetting the stability of the remaining containers in the stack. An outwardly projecting "foot" in body half 102 is configured to mate with a cooperatively formed "recess" in the body half 104 of the next adjacent container 100 when more than one containers 100 are stacked. The "foot" formed in body half 102 is a rail 128 that in a side view of the container (e.g. FIG. 2) generally is semi-cylindrical, and which extends across the entire top panel 116 (FIG. 1) along its longest dimension. The cooperatively formed "recess" 130 that receives rail 128 on an adjacent, stacked container, may be seen in FIGS. 2 and 3 and is seen to be a cooperatively shaped, generally semi-cylindrical recess that extends across the entire bottom panel 118 along its longest dimension. Together, rail 128 and recess 130 define a secure nesting system in which multiple adjacent containers 100 stacked atop one another are interlocked, as shown in FIG. 5. Although a stack of containers as shown in FIG. 5 is stable, a selected container may easily be removed from the stack by pulling on handle 126 such that the selected container slides laterally out of the stack. If a stack includes many containers 100, even removing one individual container from the bottom or lower portion of the stack will not upset the stack. Instead, the containers above the removed container drop downwardly such that they nest again in a stable stack with rails 128 interlocking recesses 130.

Figure 6:
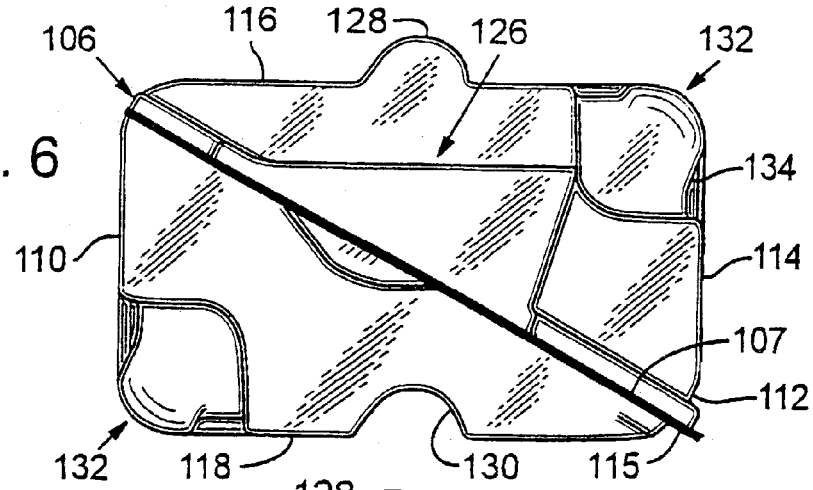
FIG. 6 is a right side elevational view of the container illustrated in FIG. 1, but showing the stack stabilization rail in a different position.

Moreover, the position of rail 128 and recess 130 relative to top panel 116 and bottom panel 118 may be varied. For example, in FIG. 6 it may be seen that rail 128 and recess 130 are formed in approximately the center of top panel 116 between corner stabilizer 132, which is described below, and hinge 106, and in a corresponding position in bottom panel 118 about midway between corner stabilizer 132 and edge 115. Positioning the rail in the middle of the panels as shown in FIG. 6 allows one container to be stacked such that is rotated 180° relative to adjacent containers. Furthermore, with rail 128 and recess 130 positioned as in FIG. 6, containers 100 of differing sizes may be stacked atop one another with the stack stabilization structures (rail 128 and recess 130) maintaining a stable stack.

Figure 9:
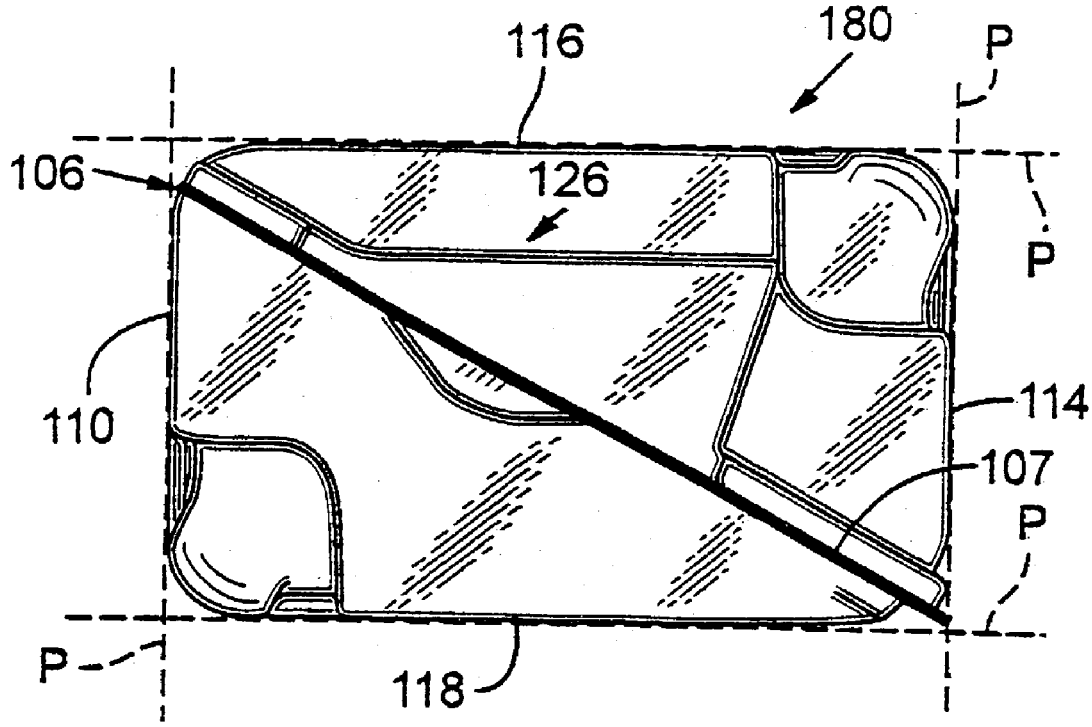
FIG. 9 is a side elevational view of a container similar to the container shown in FIG. 6, with the stack stabilization structures removed, and showing the interactions of the main container panels and the corners thereof.

Those of ordinary skill in the art will readily recognize that there are numerous alternative and equivalent structures that may be utilized to facilitate stable stacking of multiple containers, yet allowing easy removal of any particular container from the stack. For example, the system of a rail 128 extending across one panel and a cooperatively formed recess in a facing panel in an adjacent container could be replace with other equivalent structures, such as a system of posts and receptacles for the posts Moreover, as noted, the stack stabilization features defined by rail 128 and recess 130 are optional features, and a container according to the present invention may be manufactured without the rail and recesses. With reference to FIG. 9, a container 180 that is alike container 100 in all other respects is shown without either a rail 128 or a recess 130. Owing to the manner in which the containers are formed, as described below, and particularly, the manner of forming hinge 106, the container 180 may be stacked on any one of the four main sides—back panel 110, front panel 114, top panel 116 and bottom panel 118. Thus, the two body halves 102 and 104 are formed such that the geometry of hinge 106 results in a hinge that lies completely within the intersection of the planes defined by adjacent main panels. Stated another way, and with reference to FIG. 9, the hinge 106 does not interrupt or extend into the planes defined by either the back panel 110 or the top panel 116, and there are no parts of the container that extend through the planes defined by these panels. This allows the container 180 to be stacked stably on any of those panels. In FIG. 9, the planes defined by the main panels 110, 114, 116 and 118 are shown in dashed lines labeled "P". The main panels define planar sections that, as illustrated with the dashed lines P, intersect at right angles. The main panels 110, 114, 116 and 118 in FIG. 9 are flat surfaces. In some instances, it may be desirable to alter those surfaces so that they incorporate other structural components, for example, a series of reinforcing ribs that extend along the surfaces to strengthen the panels. While the surface of a panel having such reinforcing ribs would not be planar, the combined upper portions of the reinforcing ribs would define a planar surface. Accordingly, it is to be understood that as used herein, the word "plane" refers to the characteristic of a surface that extends across the main panels, regardless of whether the panels are "flat" in section or otherwise.

Likewise, flanges 117 and 115 are formed so that the joint 107 defined when the body halves are closed does not interrupt or extend into the planes defined by the bottom panel 118 or the front panel 114 (dashed lines P). Again, this allows the container 180 to be stacked stably on either front panel 114 or bottom panel 118.

It will be appreciated that the hinge and flange configuration just described allows container 180 to be stacked in any orientation and on any of the four main body panels relative to adjacent containers. With respect to a container 100 that includes a stack stabilization feature (e.g. rail 128 and recess 130), the container may be stacked on any of the three main panels 110, 118 or 114.

Container 100 further includes corner stabilization features that are designed to add dimensional stability to the corners and minimize damage to the containers that may arise from crushing. Specifically, a corner stabilizer 132 is formed into each of the four corners of container 100 that are not bisected by joint 107. The corner stabilizer 132 defines a strength-inducing radius, which is produced by an indentation 134 defined when the container is fabricated. The indentation provides structural rigidity and is formed when the container is thermoformed from a blank. The flanges 117 and 115 impart additional structural rigidity, both when the container is open and closed.

With specific reference now to FIG. 4, the interior of container 100 defines an article-holding space 124 that is configured to hold articles such as a pair of shoes without regard to any particular orientation of the shoes relative to one another. Continuing with the example of a pair of shoes, the shoes in the pair may thus be oriented in a toe-to-heel orientation, or any other orientation to display the shoes to consumers. Recess 130, which as described above defines a stack stabilization feature, projects inwardly into interior space 124 and provides a laterally extending support or ledge on the interior of the container on which one of the shoes may be placed to facilitate a unique view of the shoe. For example, and depending upon placement of the shoe in space 124, the consumer may be able to see the shoe from a perspective view that allows portions of the sole and the upper to be easily seen.

Container 100 is preferably fabricated from a clear material so that goods held within the container are plainly visible through the container panels. As used herein, the word "clear" refers to any transparent or translucent material used to fabricate the container and through which the interior of the container may be seen. Many materials may be used to fabricate the container. These include numerous grades of PET (polyethylene terephthalate), high density polyethylene (HDPE), low density polyethylene (LDPE), and vinyls such as various grades of polyvinyl chloride (PVC). Those or ordinary skill in the art will recognize that the material selected will depend upon the structural and cosmetic requirements of the particular package. The polymers used to manufacture container 100 may include modifier compounds such as softeners, impact modifiers and the like, depending upon the application. In a preferred embodiment the material selected for manufacturing the container will include a high percentage of recycled material.

The material used to form container 100 may be clear, colored, or and any combination of coloring may be used. Moreover, portions of the container may be opaque so long as at least some of the container is clear to display the contents.

Figure 8:
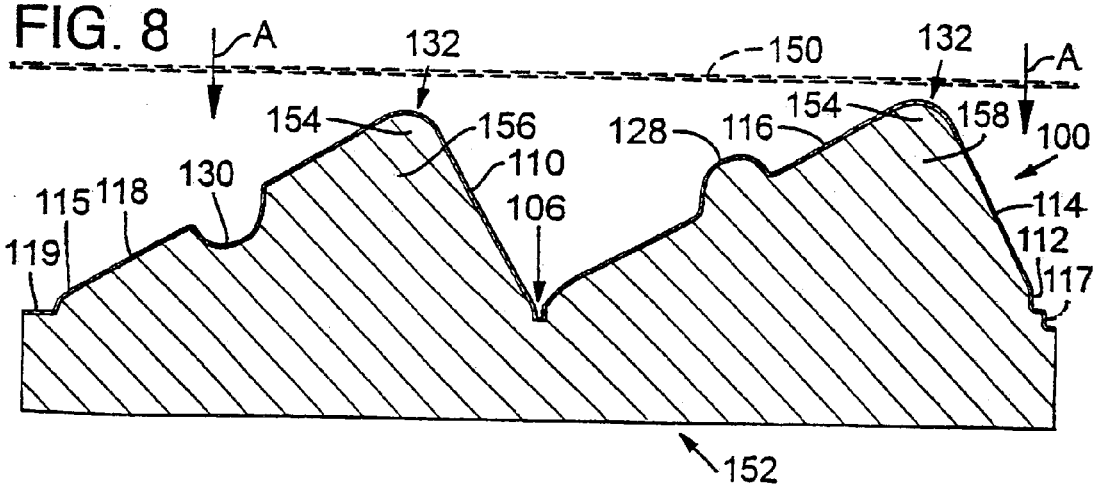
FIG. 8 is a side elevational, schematic view of the a preferred method of making the container of FIG. 7, showing a blank of material in dashed lines over a schematic representation of the forming tool, and showing the blank pulled onto the tool.

The container of the present invention is preferably formed using a thermoforming processes whereby a blank of material is pulled into a tool or mold, for instance with a vacuum, to form the container. With reference to FIG. 8 it may be seen that container 100 is formed in an inverted position such that a blank of plastic material 150, illustrated in dashed lines, is positioned over the forming tool 152, which is shown in section, and schematically. Tool 152 is the type of tool known in the industry as a "male" tool. A male tool is preferably used to thermoform container 100 because during the thermoforming process, those portions of material 150 that are nearest the tool when thermoforming occurs are the thickest portions of the finished part. Tool 152 comprises a first male part 156 and a second male part 158, each of which is roughly triangular in cross section and each of which has an apex 154 that lies closest to the plastic material 150 prior to the forming process. It will be appreciated that first male part 156 forms body half 104 and that second male part 158 forms body half 102. The two parts 156 and 158 are positioned close together to define hinge 106 at the junction between the two parts. The hinge 106 formed from the combination of the two parts 156 and 158 is, as described above, unobtrusive with respect to the main panels of the container. Additionally, the hinge is formed without the need for cutting any of the material 150.

With specific reference to FIG. 8, the thickest portions of the container formed on tool 152 are those portions of the container that are formed at apexes 154 as the material 150 is pulled downwardly into the tool (in the direction of arrows A). Thus, the corners of the container 100 are strengthened not only by corner stabilizers 132 described above, but also because the corners of the container are formed of the thickest material in the container. As such, the corners are quite strong and resistant to crushing. On the other hand, the thinnest portions of the finished part are those portions that are located at the greatest distance from the initial interface between material 150 and the uppermost portions of the tool, which in the embodiment shown correspond to apexes 154. In other words, as material 150 is pulled downwardly into the tool from its original, planar position (in dashed lines in FIG. 8), the thickness of material 150 tends to decrease the further the material is pulled into the tool. As a result, the thinnest portion of container 100 in FIG. 8 is found at hinge 106 and at lower edge 112 of front panel 114, and lower edge 115 of bottom panel 118, which is the point furthest from apexes 154. This increases the flexibility of the hinge 116 and makes it more readily bendable, and the ability of the flanges 117 and 115 to mate together when the container halves are closed.

Figure 7:
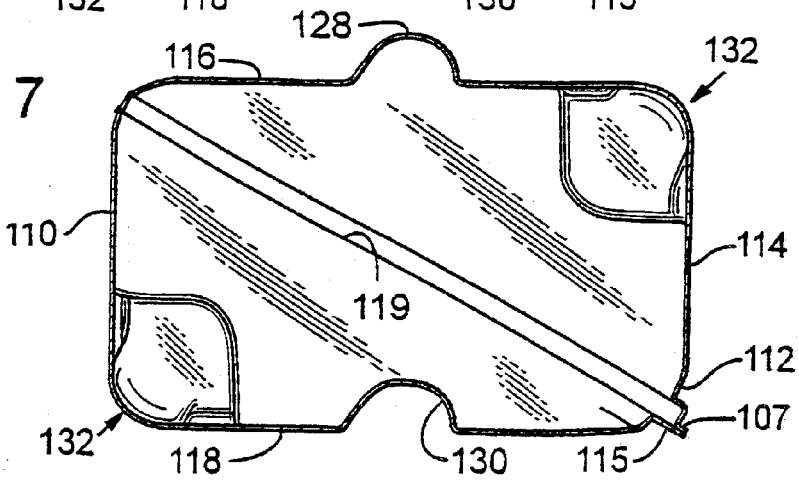
FIG. 7 is a cross sectional view of the container illustrated in FIG. 6, taken at approximately the middle of the longest dimension of container.

It will further be noted that the tool 152 is formed such that there are no "reverse drafts" or "negative drafts" in the container 100. For example, and with reference to the cross sectional configuration of rail 128 and recess 130, the rail is generally cylindrical in shape, but as best seen in FIG. 7, is non-concentric. Because these portions are not perfectly rounded, the container is easily separate from tool 152 after container 100 is formed. Moreover, numerous empty containers may be nested within one another yet easily separated.

Again with reference to use of container 100 as a container for shoes, preferably the package is sized such that one container will fit several different sizes of shoes. Thus, as one example, a blank container 100 may be designed to hold a specific style of shoes (such as athletic shoes) in the size range of men's sizes 7 to 9 (in the traditional U.S. sizing system), and also women's athletic shoes in sizes 9 to 11. And while the container of the present invention may often be smaller than traditional rectangular shoeboxes designed for the same sizes of shoes, it is close enough in size so that it may be used without modification to the existing shoe distribution, warehousing and sale infrastructure.

The blank or empty containers 100 are designed so that they may be nested with other blanks. The container 100 illustrated in FIG. 4 thus could be stacked and nested with other containers for ease of shipping and to minimize the space required for shipping many empty containers. It will be appreciated that with the illustrated configurations, many blanks may be nested for shipping to a manufacturing facility in a minimal amount of space, and much less space than would be occupied by an equal number of paperboard box blanks. Further, the container of the present invention is ready for use and does not need to be built or set up by the user. This saves on both labor and equipment costs.

Those of skill in the art will further recognize the many different shapes that can be used to define a container equivalent to the container described herein. Thus, to name but a few examples, the container could be formed with more than one handle, the article-receiving space inside of the container may be designed to conform more uniquely to a specific article, and as noted previously, there are numerous methods of facilitating stacking in stable stacks. Moreover, while numerous different shapes are envisioned for both the interior space of the container and the overall container shape, in the preferred embodiment the container is roughly equivalent in size and shape to a standard shoebox for holding a pair of shoes of similar size. In this way the container of the present invention is accommodated easily into existing footwear manufacturing, distribution and sales infrastructure.

While the present invention has been described in terms of a preferred embodiment, it will be appreciated by one of ordinary skill that the spirit and scope of the invention is not limited to those embodiments, but extend to the various modifications and equivalents as defined in the appended claims.

We claim:

1. A thermoformed container, comprising:

a container base defining bottom and rear panels, said rear panel being substantially planar over the entire surface thereof;

a container lid defining top and front panels, said container lid sized to matingly engage the container base in a closed position to define an interior space configured for receiving an article;

a hinge interconnects the rear panel of the base to the top panel of the lid at an upper edge of said rear panel and a rear edge of said top panel to allow the lid to be selectively moved from a closed position in which the lid engages the base to an open position in which the lid disengages the base;

wherein the outer surface of the top panel defines a top panel plane, the outer surface of the rear panel defines a rear panel plane, the outer surface of the front panel defines a front panel plan and the outer surface of the bottom panel defines a bottom panel plane, the rear panel plane intersects the top and bottom panel planes, and the front panel plane intersects the top and bottom panel planes to define four interior angles at the intersections of said planes, and wherein the hinge is located within the interior angle defined by the intersection between said top and rear panel planes;

opposed lateral side panels wherein the base mates to the lid along a joint that extends diagonally across the lateral side panels from the hinge toward the front panel; and a handle integrally formed on one of said lateral side panels, said handle defined by an upper handle portion formed in the container lid on one side of the diagonally extending joint and a lower handle portion formed in the container base on the opposite side of the diagonally extending joint, said upper handle portion having a downwardly extending pocket formed in the container lid and said lower handle portion having a cooperatively formed downwardly extending pocket such that said pocket in said lower handle portion at least partially receives said pocket in said upper handle portion when the container is in the closed position to thereby stabilize the handle, and said handle further including an upwardly extending protrusion formed on said lower handle portion in a position to be received in a cooperatively shaped upwardly extending opening in said upper handle portion when the container is in the closed position and to thereby stabilize the handle.

2. The container according to claim 1 wherein the joint extends across the front panel adjacent a lower edge thereof.

3. The container according to claim 2 wherein the joint is located within the interior angle defined by the intersection between said front and bottom panel planes.

4. The container according to claim 1 wherein a major portion of the container base or container lid is fabricated from a clear material.

5. The container according to claim 3 wherein the hinge is a living hinge and the lid is movable about the hinge between an open position and a closed position.

6. The container according to claim 1 including means for preventing relative movement of individual containers in a stack of containers.

7. The container according to claim 6 wherein the means for preventing relative movement further comprises an outwardly projecting rail formed on the lid top panel and a cooperative recess formed in the base bottom panel, the recess sized to receive a rail.

8. The container according to claim 3 wherein the front panel defines a substantially flat surface.

9. The container according to claim 1 wherein the base mates to the lid along a joint extending across the front panel adjacent a lower edge thereof, and wherein the joint lies completely within the interior angle defined by the intersection of the planes defined by the front panel and bottom panel.

10. A container for packaging an article, comprising:

top and bottom shell halves integrally formed with a hinge interconnecting said halves, said top half defining a top panel and a front panel and said bottom half defining a rear panel and a bottom panel, wherein said hinge interconnects said rear panel to said top panel where an upper edge of said rear panel meets a rear edge of said top panel, said top and bottom shell halves selectively movable about said hinge between a closed position and an open position;

opposed lateral side panels wherein the top shell half mates to the bottom shell half along a joint that extends diagonally across the lateral side panels from the hinge toward the front panel;

wherein the outer surface of said top panel and the outer surface of said rear panel define respective top and rear planes that intersect in proximity to said hinge, and the hinge does not extend into the plane of either of the top panel or the rear panel outwardly of said top or rear panels and said rear panel is substantially planar over the entire surface thereof;

a rail formed on the top panel such that the rail extends in a direction parallel to the hinge, and a cooperatively formed recess formed on the bottom panel such that the recess extends in a direction parallel to the hinge and completely across the bottom panel, the rail and the recess formed in positions on the respective top and bottom panels such that when first and second containers are stacked the rail on the first container is received into the recess on the second container to interlock the first and second containers, yet allow the first and second containers to be slid relative to one another in the direction parallel to said rail and recess; and a handle integrally formed on one of said lateral side panels, said handle defined by an upper portion formed in said lateral side panel on an upper side of the diagonally extending joint and a lower portion formed in said lateral side panel on a lower side of the diagonally extending joint, said handle having a downwardly extending pocket formed in the upper portion and a cooperatively formed downwardly extending pocket formed in the lower portion such that said pocket in said lower portion at least partially receives said pocket in said upper portion when the container is in the closed position to thereby stabilize the handle, and said handle further including an upwardly extending protrusion formed on said lower portion in a position to be received in a cooperatively shaped upwardly extending pocket in said upper portion when the container is in the closed position to thereby stabilize the handle.

11. The container according to claim 10 wherein said top shell half and said bottom shell half each include a pair of corners, each of said corners includes an indentation defining a radius formed in the corner.

12. The container according to claim 11 formed of a plastic material having a thickness, and wherein the material at the hinge is relatively less thick than the material at the corners.

13. A container, comprising:

a base;

a lid hinged to the base and sized to engage the base to define a container having a top panel, bottom panel, front panel, back panel and opposed lateral side panels, wherein the hinge joins the back panel of the base along an upper edge thereof to the top panel of the lid along a rear edge thereof, and the outer surface of the top panel defines a top panel plane that is transverse to a back panel plane defined by the outer surface of the back panel, the outer surface of the front panel defines a front panel plane that is transverse to a bottom panel plane defined by the outer surface of the bottom panel to thereby define four interior angles at the intersections of said front and rear panel planes with said top and bottom panel planes, and the base and lid lie completely within the said four interior angles;

wherein the base mates to the lid along a joint extending across the front panel adjacent a lower edge thereof, and wherein the joint lies completely within the interior angle defined by the intersection of the planes defined by the front panel and bottom panel;

opposed side panels wherein the lid mates to the base along a joint that extends diagonally across the lateral side panels from the hinge toward the front panel;

stabilization means for stabilizing a stack of plural containers by interlocking adjacent containers in the stack while allowing individual containers to be removed from the stack, said stabilization means defined by a rail formed on the top panel in a direction parallel to the hinge, and a cooperatively formed recess formed on the bottom panel in a direction parallel to the hinge, said recess extending completely across the bottom panel, and the rail and the recess formed in positions on the respective top and bottom panels such that when first and second containers are stacked the rail on the first container is received into the recess on the second container to interlock the first and second containers; and handle means for allowing removal of an individual container from a stack of containers and for stabilizing the handle to prevent relative movement between said lid and said base, said handle means comprising an upper handle portion formed in said lid on an upper side of the diagonally extending joint and a lower handle portion formed in said base on the opposite side of the diagonally extending joint, said upper handle portion having a downwardly extending pocket that cooperatively engages a pocket formed in the lower handle portion such that the downwardly extending pocket in the upper handle portion is at least partially received in said pocket in said lower portion when the container is in the closed position to thereby stabilize the handle, and said handle means further comprising an upwardly extending protrusion formed on said base in a position to be received in a cooperatively shaped pocket in said lid when the container is in the closed position and to thereby stabilize the handle.

14. The container according to claim 13 wherein the bottom panel defines a substantially flat surface.

* * * * *